United States Patent [19]

Hussamy

[11] 4,308,025

[45] Dec. 29, 1981

[54] SIMULTANEOUS BULKING AND DYEING PROCESS

[75] Inventor: Samir Hussamy, Lynchburg, Va.

[73] Assignee: Burlington Industries, Inc., Greensboro, N.C.

[21] Appl. No.: 177,512

[22] Filed: Aug. 12, 1980

Related U.S. Application Data

[63] Continuation-in-part of Ser. No. 97,373, Nov. 26, 1979, Pat. No. 4,238,191, which is a continuation of Ser. No. 659,637, Feb. 20, 1976, abandoned.

[51] Int. Cl.[3] ..... C09B 67/00

[52] U.S. Cl. ..... 8/594; 8/531; 8/611; 8/648; 8/654; 8/680; 8/130.1; 8/924; 8/638

[58] Field of Search ..... 8/531, 594, 611, 924, 8/130.1, 654, 648, 680

[56] References Cited

U.S. PATENT DOCUMENTS

| | | | |
|---|---|---|---|
| 3,154,374 | 10/1964 | Gruschke et al. | 8/130.1 |
| 3,170,757 | 2/1965 | Gift et al. | 8/559 |
| 3,467,484 | 9/1969 | Hermes | 8/589 |
| 3,510,891 | 5/1970 | Luongo | 8/598 |
| 3,700,405 | 10/1972 | Petite et al. | 8/607 |
| 3,702,229 | 11/1972 | Campana | 8/585 |
| 3,932,128 | 1/1976 | Beaulieu | 8/583 |
| 4,238,191 | 12/1980 | Hussamy | 8/130.1 |

*Primary Examiner*—A. Lionel Clingman

*Attorney, Agent, or Firm*—Cushman, Darby & Cushman

[57] ABSTRACT

A process for simultaneously bulking and dyeing linear polycarbonamide fibers which comprises treating the same with a solution of an alcohol containing a tinctorial amount of at least one dyestuff therein, and thereafter washing the treated fibers in hot water, soaping, and washing in hot and cold water and drying.

21 Claims, No Drawings

SIMULTANEOUS BULKING AND DYEING PROCESS

CROSS-REFERENCE TO RELATED APPLICATION

This is a continuation-in-part of my earlier application Ser. No. 97,373 filed Nov. 26, 1979 now U.S. Pat. No. 4,238,191 which, in turn, is a Continuation of my earlier application Ser. No. 659,637 filed Feb. 20, 1976, now abandoned.

BACKGROUND OF THE INVENTION

The present invention is concerned with the simultaneous bulking and dyeing of linear polycarbonamide fibers.

The fibers with which the invention is concerned are silk-like linear, high molecular weight polyamide fibers in which at least 90% of the repeating units have the formula

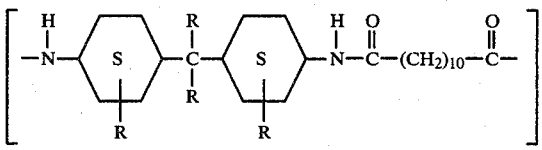

where S indicates a saturated cyclohexyl ring and the R substituents, which may be the same or different, are hydrogen and methyl. At least 40% by weight of the diamine constituent of the repeating unit is of the trans-trans (++) sterioisomeric configuration.

Fibers of the above type, and fabrics made therefrom, are described in U.S. Pat. No. 3,393,210, the subject matter of which is incorporated herein. Typically, the fibers are made from the polyamide polycondensate of 4,4'-diaminodicyclohexylmethane with dodecanedioic acid. Such material is commercially available depending on finish, denier, etc., as Nylon Types 470, 472, 473 trademarked as "Qiana" and available from the Textile Fibers Department of E. I. DuPont de Nemours & Co. (Inc.). The material has a silk-like handle, a density of 1.04, and a crystallinity similar to polyester fibers as reported by A. Liddiard, Review of Progress in Coloration, Vol. 1, page 64, June '67–September '69.

It is disclosed in DuPont's bulletin on Preparation, Dyeing and Finishing Woven and Warp Knit Fabrics of Type 470, Type 472, and/or T-473 Nylon Filament Yarns, that these fabrics can be thermally bulked and stabilized in the greige state or after being scoured and dried, either on an externally taperable pin tenter frame, or on a rotational hot roll contact unit, or similar type machines. It is clearly stated in the instructions for finishing such nylons that the fabrics must be thermally bulked and heat set before dyeing for beck and beam dyeing or thermally bulked and heat-set after dyeing for jig dyeing. However, heat bulking as such tends to yellow the "Qiana", renders it more difficult to dye, and does not help develop the silk-like handle of the fabric to its fullest degree.

My earlier application in Ireland, Ser. No. 2816/76 filed Dec. 22, 1976, available to the public on Aug. 20, 1977, describes a process for premanently bulking and stabilizing linear polycarbonamide fibers of the Qiana type, as well as developing the silk-like handle thereof, in which the fabric is treated with a solution or emulsion of an alcohol, washed and dried in order to bulk such fibers. To my knowledge, the art has not described a process wherein nylon Type 470, 472 or 473 fibers are chemically bulked and dyed at the same time. Also prior to my invention as herein described, it has been impossible to obtain deep bright dyeings of Qiana-type fabrics using the cationic-type (basic) dyes and using the process it is now possible to dye with cationic dyes and achieve strong, brilliant and fluorescent colorings on Qiana-type fabrics.

The principal object of the present invention is to provide a process for the simultaneous bulking and dyeing of fabrics made from fibers of the type indicated above (Type 470, Type 472 and/or Type 473 Nylon filament yarn "Qiana") which obviates prior art problems and positively develops the silk-like handle of these fabrics to their fullest degree while at the same time dyeing the fabrics.

These and other objects will also be apparent from the following more detailed description of the invention.

DESCRIPTION OF THE INVENTION

Broadly stated, the objects of the present invention are realized by treating a textile substrate, notably a knit or woven fabric, comprising silk-like linear, high molecular weight polycarbonamide fibers in which at least about 90% of the repeating units have the formula

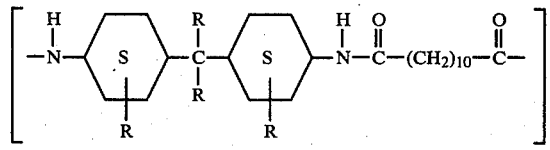

where R is hydrogen or methyl as stated above, with an aqueous solution containing 1–99.99% by weight of one or more aromatic or aliphatic alcohols or a non-aqueous solution of two or more alcohols. Solubilized in the solution is a tinctorial amount of at least one dyestuff, as described in more detail below. For the production of white goods, a fluorescent brightening agent is solubilized in the solution. After the alcohol-dye or the alcohol-fluorescent brightening agent solution is applied, the fabric is washed in hot and cold water, and then dried.

The dyeing of heat bulked "Qiana" fibers using a dyebath containing an alcohol is described in U.S. Pat. No. 3,700,405; printing "Qiana" fibers using anionic dyes and a carrier therefor which may be an alcohol is also disclosed in U.S. Pat. No. 3,702,229. Treatment of "Qiana" fabrics with alcohols for the purpose of bulking the fabric while at the same time dyeing the fabric does not appear to be disclosed in these patents as it is customary, prior to the present invention, to first heat bulk the fabric prior to dyeing operations.

The present process may be applied to any type of woven or knit fabric consisting entirely or in substantial part, e.g., about 35% by weight or more, of fibers as described above. Thus, the treatment of various blends of Qiana-type fibers with polyester, cotton and the like is included within my invention.

Advantageously, the process is carried out by treating the dry, unbulked fabric in the prescoured or scoured, undyed condition, and in the relaxed state, into a bath which contains one or more of the indicated alcohols, dyestuffs, and fluorescent brightening agents as more fully identified below. The bath is usually an aqueous solution of the alcohol; mixtures of two or more alcohols may be used. The amount of dyestuff, fluorescent brightening agent or mixture of dyestuffs or fluorescent brightening agents or mixtures of dyestuffs and fluorescent brightening agents in the bath is sufficient to impart the desired color or optical brightening effect to the fabric and the required amount can readily be determined by one skilled in the art. Such amount will generally be in the range of from 0.01% up to about 10% by weight, or possibly more, calculated on the total weight of the bath, depending on the depth of shade required. The alcohol may be dissolved in water or some other liquid vehicle which is inert to the fabric and easily removed therefrom. A homogeneous solution without phase separation is required.

The process of the invention can be carried out on a continuous basis, such as pad in the alcohol/dyestuff or fluorescent brightening agent bath—sky—immerse in hot water—scour—rinse in cold water—dye, or on a discontinuous process, such as pad in the dye or fluorescent brightening agent/alcohol bath—batch—immerse in hot water—scour—rinse in cold water—dry. Either greige or prepared but not heated bulked or set Qiana-type knit or woven goods can be used in the process.

A wide variety of aliphatic, including cycloaliphatic, and aromatic alcohols may be used in the present process. Examples of such alcohols include the saturated aliphatic, monohydric and polyhydric alcohols such as methyl, ethyl, n-porpyl, isopropyl and n-butyl, isobutyl, sec-butyl, t-butyl, n-amyl, n-hexyl, n-heptyl, n-octyl, capric, n-decyl, lauryl, myristyl, cetyl or stearyl alcohol, ethylene glycol or cyclohexanol; unsaturated alcohols such as allyl alcohol; aromatic alcohols such as benzyl alcohol, phenethyl alcohol, 1-phenyl-1-propyl alcohol, 2-phenyl-2-propyl alcohol, 3-phenyl-1-propyl alcohol; furfuryl alcohol, and alcohols having one of the following formulae:

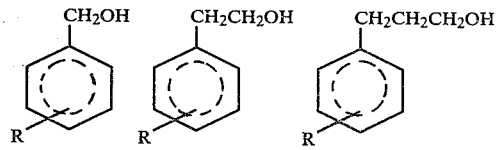

wherein R is a member of the class consisting of halogen, hydroxyl, amino, nitro, alkyl, —$CH_2OH$, —$CH_2CH_2OH$, and —$CH_2CH_2CH_2OH$. Preferred alcohols are methyl alcohol and benzyl alcohol and nonaqueous mixtures of the two.

The treatment with alcohol and dye can be carried out at various temperatures. Advantageously the bath is kept at room or ambient temperature of about 20°–25° C.

The dyestuff used in accordance with the present process is preferably a disperse, acid or cationic-type dyestuff or various combinations thereof. Suitable dyestuffs are described in the Colour Index published by the Society of Dyers and Colourists and The American Association of Textile Chemists and Colorists. Preferably, disperse dyes are used either with the acid dyes or with the cationic "basic" dyes. When cationic "basic" dyestuffs are used, it is necessary to include a small amount, i.e., up to 10% by weight calculated on the weight of bath, of an acid substance and water to achieve the desired color penetration and build-up of shade. Such materials include various organic acids or which the following are representative; maleic, fumaric, cinnamic, phthalic, oxalic, crotonic, succinic, naphthalic, benzoic, malonic, glutaric, adipic, suberic, sebasic, azelaic, citric, acetic, formic, dichloracetic, trichloracetic, propionic acids. Of these acids, maleic, fumaric, cinnamic, and phthalic acid are preferred. The exact reason for the presence of an acid is not now understood, but such materials are necessary in order to adequately dye Type 470, 472 and 473 nylons with cationic dyes.

The duration of the treatment with alcohol and dye can also be varied over a relatively wide range. The time is normally selected for any particular situation to optimize the bulking and other desired properties, as well as achieving the requisite depth of shade.

After the treatment with alcohol and dye, it is necessary to wash the fabric in hot water, for example, at about 40° to about 100° C., and then to soap and finally wash in hot and cold water. The washed fabric is thereafter dried in any convenient fashion such as by hot air drying in the relaxed state, to give the desired bulked and dyed product.

The exact mechanism of the process of my invention is at present unclear, however during the bulking process the dye molecules are fully penetrated and trapped inside the fiber.

EXAMPLES OF THE INVENTION

The invention is illustrated, but not limited, by the following examples wherein parts are by weight unless otherwise stated:

EXAMPLE 1

A greige knit fabric composed of 100% Qiana Type 472 fiber was padded "100% pick up" in a dye solution composed of 5% Dispersol Blue BG, C.I. disperse blue 26, 10% benzyl alcohol, and 85% methyl alcohol in open width at room temperature, batched for one hour at room temperature (65°–75° F.), immersed for two minutes in hot water at 205° F., scoured for five minutes in a 0.5% soda ash and 0.5% Merpol SH solution at 165° F., rinsed first in hot and then in cold water, and dryed. The fabric is then ready for finishing. The fabric was bulked, had a suitable hand and was dyed to a medium blue color.

EXAMPLE 2

A griege knit fabric composed of 100% Qiana Type 472 fiber was padded "100% pick up" in a dye solution composed of 5% Latyl Cerise YLN, C.I. disperse red 55, 10% benzyl alcohol, 85% methyl alcohol, in open width at room temperature, skyed for five minutes, immersed in hot water at 205° F. for two minutes, then scoured and rinsed as in Example 1. The process was carried out continuously, and the fabric was thus bulked and dyed to a solid pink color.

EXAMPLE 3

The procedure of Example 1 was repeated except that 5% Resolin Brilliant Yellow P-GG C.I. disperse yellow 74 was used in this case. The fabric was bulked and dyed into a strong yellow color.

EXAMPLE 4

The procedure of Example 1 was repeated except that 8% Cibacet Black QB and 0.4% Resolin Brilliant Yellow P-GG C.I. disperse yellow 74 were used as dyes in this case and the methyl alcohol content adjusted accordingly. The fabric was bulked and dyed to a strong black color.

EXAMPLE 5

The procedure of Example 1 was repeated except that 4% Telon Red AFG, C.I. Acid Red 360 was used as dye in this case and the methyl alcohol content adjusted accordingly. The fabric was bulked and dyed into a strong red color.

EXAMPLE 6

The procedure in this example was the same as in Example 2, except that 4% Telon Blue RRL, C.I. Acid Blue 62 dye was used and the methyl alcohol content adjusted accordingly. The Qiana was bulked and dyed to a strong blue color.

EXAMPLE 7

The experimental procedure in this example was the same as in Example 1 above, except that 4% Telon Yellow FGL, C.I. Acid Yellow 49 was used and the methyl alcohol content adjusted accordingly. The fabric was bulked and dyed to a strong yellow shade.

EXAMPLE 8

A greige knit fabric composed of 100% Qiana Type 472 fiber was padded in a dye solution composed of 2% Sevron Red D, C.I. Basic Red 19, 7% maleic acid, 35% benzyl alcohol, 40% methanol, and 16% water, at room temperature, batched for two hours at room temperature, immersed in hot water at 205° F. for two (2) minutes, scoured for five (5) minutes in a solution of 0.5% acetic acid and 0.5% Duponol D at 180° F., rinsed in hot and cold water, and dried. The fabric was bulked and dyed into a strong bright pink color which was fluorescent under U.V. light, with good overall fastness properties.

EXAMPLE 9

A greige knit fabric composed of 100% Qiana Type 472 fiber was padded in a dye solution composed of 2% Sevron Red 3B, C.I. Basic Violet 15, 7% maleic acid, 35% benzyl alcohol, 48% methanol and 8% water at room temperature, skyed for five minutes, immersed in hot water at 208° F. for two minutes, scoured for two minutes in a solution of 0.5% acetic acid and 0.5% Duponol D at 180° F., rinsed first in hot and then in cold water, all in open width, and dried. The fabic was bulked and dyed into a strong bright violet shade which are fluorescent under U.V. light, with good overall fastness properties.

EXAMPLE 10

The same was used as in Example 8, except that the dye was 2% Maxilon Flavine 10GFF, C.I. Basic Yellow 40. The fabric was bulked and dyed into a strong greenish-yellow shade that was fluorescent under U.V. light, with good overall fastness properties.

EXAMPLE 11

The same as in Example 8 was used, except that the dye used in this case was a mixture of 2% Sevron Red D, C.I. Basic Red 19, and 2% Sevron Yellow 6DL, C.I. Basis Yellow 29 with the methanol content adjusted accordingly. The fabric was bulked and dyed into a strong bright shade of red which was fluorescent under U.V. light, with good overall fastness properties.

EXAMPLE 12

The same procedure was used as in Example 8, except that the dye used in this case was a mixture of 1.4% Maxilon Flavine 10GFF, C.I. Basic Yellow 40, and 0.32% Sevron blue ER, C.I. Basic Blue 77. The fabric was bulked and dyed into a strong bright green shade which was fluorescent under U.V. light, with good overall fastness properties.

EXAMPLE 13

A greige knit fabric composed of 100% Qiana Type 472 fiber was padded with "100% pick up" in a fluorescent brightening agent solution composed of 0.5% Uvitex EBF Conc. C.I. fluorescent brightness 185, 14.5% benzyl alcohol, and 85% methyl alcohol in open width at room temperature, batched for one hour at room temperature (65°–75° F.), immersed for two minutes in hot water at 205° F., scoured for five minutes in a 0.5% soda ash and 0.5% Merpol SH solution at 165° F., rinsed first in hot and then in cold water, dryed, and frame finished. The fabric was bulked, had a suitable hand and optically brightened to a good white.

EXAMPLE 14

A greige knit fabric composed of 50/50 Qiana Types 470/472 fiber was padded with "100% pick up" in a fluorescent brightening agent solution composed of 1% Blancophor AW, C.I. fluorescent brightener 61, 14% benzyl alcohol, and 85% methyl alcohol in open width at room temperature, skyed for five minutes, immersed in hot water at 205° F. for two minutes, then scoured and rinsed as in Example 13. The process was carried out continuously, and the fabric was bulked, had a suitable hand and optically brightened to a good white.

TRADEMARKS/VENDOR TABLE

| Name | Vendor |
|---|---|
| Dispersol Blue BG | I.C.I. |
| Latyl Cerise YLN | DuPont, E.I., de Nemours Co., Inc. |
| Resolin Brilliant Yellow PGG | Mobay Chemical Corporation |
| Cibacet Black QB | Ciba/Geigy Corporation |
| Telon Red AFG | Mobay Chemical Corporation |
| Telon Blue RRL | Mobay Chemical Corporation |
| Telon Yellow FGL | Mobay Chemical Corporation |
| Sevron Red D. | DuPont, E.I., de Nemours Co., Inc. |
| Sevron Red 3B | DuPont, E.I., de Nemours Co., Inc. |
| Sevron Yellow 6DL | DuPont, E.I., de Nemours Co., Inc. |
| Sevron Blue ER | DuPont, E.I., de Nemours Co., Inc. |
| Merpol SH (scouring agent, ethylene oxide condensate) | DuPont, E.I., de Nemours Co., Inc. |
| Duponol D ("detergent" sodium mixed long-chain alcohol sulfate) | DuPont, E.I., de Nemours Co., Inc. |
| Maxilon Flavine 10GFF | Mobay Chemical Corporation |
| Uvitex EBF Conc. | Ciba/Geigy Corporation |
| Blancophor AW | GAF Corporation |

What is claimed is:

1. A process for simultaneously bulking and dyeing linear polycarbonamide fibers comprising the steps of:

(1) treating unbulked linear polycarbonamide fibers wherein at least about 90% of the repeating units in said fibers have the formula:

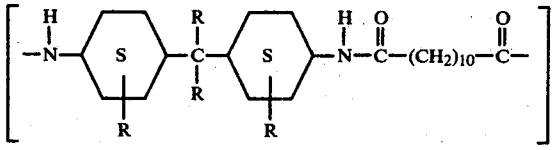

wherein R is hydrogen or methyl by contacting said fibers with a solution containing at least one percent by weight of at least one alcohol and a tinctorial amount of a dyestuff, the treatment being conducted at ambient temperature;

(2) washing the thus-treated fibers in hot water;

(3) soaping the thus-treated fibers;

(4) washing the soaped fibers in hot and cold water; and (5) drying the bulked and dyed fibers.

2. The process of claim 1 wherein said fibers are treated at a temperature of about 20° to about 25° C.

3. The process of claim 1 wherein the solution is a non-aqueous mixture of two or more alcohols and a disperse dye, an acid dye or a mixture of a disperse dye and an acid dye.

4. The process of claim 1 wherein the solution is an aqueous or non-aqueous mixture of two or more alcohols and a fluorescent brightening agent.

5. The process of claim 1 wherein the solution is an aqueous solution of at least one alcohol, up to 10% by weight of an organic acid and at least one cationic dye.

6. The process of claim 3 wherein the solution contains a mixture of methyl alcohol and benzyl alcohol.

7. The process of claim 5 wherein the organic acid is maleic acid, fumaric acid, cinnamic acid, phthalic acid or mixture thereof.

8. The process of claim 5 wherein the solution contains maleic acid, methyl alcohol, benzyl alcohol and water.

9. The process of claim 1 or 2 wherein step (2) is conducted at a temperature of about 90° to about 100° C.

10. The process of claim 1 or 2 wherein step (3) is conducted at a temperature of about 90° to about 100° C.

11. A process for simultaneously bulking and dyeing linear polycarbonamide fibers comprising the steps of:

(a) contacting unbulked linear polycarbonamide fibers, wherein at least about 90% of the repeating units in said fibers have the formula:

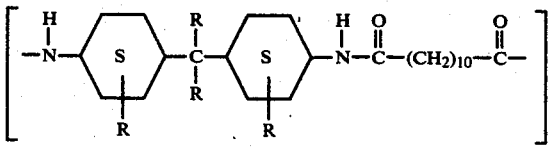

wherein R is hydrogen or methyl, with an aqueous solution containing at least one percent by weight of an alcohol, a tinctorial amount of a cationic "basic"]dye and an organic acid, said contacting being conducted at a temperature in the range of about 20° C. to about 25° C.;

(b) washing the contacted fibers in hot water at a temperature of about 40° C. to about 100° C.; and thereafter (c) soaping at 20° to 100° C. hot water;

(d) washing the fibers in water at a temperature of about 40° C. to about 100° C.; and then in cold water at a temperature of 10°–20° C.; and (e) drying the thus-bulked and dyed fibers.

12. The process of claim 11 wherein the solution is a mixture of two or more alcohols and additionally contains a fluorescent brightening agent.

13. The process of claim 12 wherein the solution contains a mixture of methyl alcohol and benzyl alcohol.

14. The process of caim 11 wherein the organic acid is maleic acid, fumaric acid, cinnamic acid, phthalic acid or mixtures thereof.

15. The process of claim 11 wherein the organic acid is maleic acid, fumaric acid or their mixture.

16. The process of claim 11 wherein the solution contains maleic acid, methyl alcohol, benzyl alcohol and water.

17. The process of claim 11 wherein step (d) is conducted at a temperature of about 90° to about 100° C.

18. The process of claim 11 wherein step (c) is conducted at a temperature of about 90° to about 100° C.

19. The process of claim 1 or 11 wherein the amount of dye present in the solution is from 0.01 to 10% by weight.

20. A process for simultaneously bulking and dyeing linear polycarbonamide fibers comprising the steps of:

(1) treating unbulked linear polycarbonamide fibers wherein at least about 90% of the repeating units in said fibers have the formula:

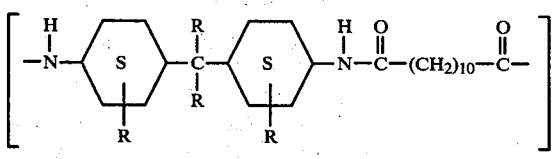

wherein R is hydrogen or methyl by contacting said fibers with a non-aqueous mixture of two or more alcohols and an optical brightener, a disperse dye, an acid dye or a mixture of a disperse dye and an acid dye, the treatment being conducted at ambient temperature until optical brightener, dye molecules are fully penetrated and trapped inside the fiber;

(2) washing the thus-treated fibers in hot water;

(3) soaping the thus-treated fibers;

(4) washing the soaped fibers in hot and cold water; and (5) drying the bulked and dyed fibers.

21. The process of claim 20 wherein the mixture contains methyl alcohol and benzyl alcohol.

* * * * *